US006460807B1

(12) United States Patent
Braitinger et al.

(10) Patent No.: US 6,460,807 B1
(45) Date of Patent: Oct. 8, 2002

(54) MISSILE COMPONENTS MADE OF FIBER-REINFORCED CERAMICS

(75) Inventors: Manfred Braitinger, Vaterstetten; Manfred Selzer, Oberhaching; Ulrich Papenburg, Egmating, all of (DE)

(73) Assignee: Industrieanlagen-Betriebsgesellschaft GmbH (DE)

( * ) Notice: Subject to any disclaimer, the term of this patent is extended or adjusted under 35 U.S.C. 154(b) by 0 days.

(21) Appl. No.: 09/242,372

(22) PCT Filed: Aug. 4, 1997

(86) PCT No.: PCT/EP97/04235

§ 371 (c)(1),
(2), (4) Date: Dec. 10, 1999

(87) PCT Pub. No.: WO98/08044

PCT Pub. Date: Feb. 26, 1998

(30) Foreign Application Priority Data

Aug. 16, 1996 (DE) ..... 196 32 893

(51) Int. Cl.[7] ..... B32B 5/27; B32B 1/04

(52) U.S. Cl. ..... 244/133; 244/172; 244/117 R; 102/374

(58) Field of Search ..... 102/374; 244/119, 244/133, 172, 117 A, 117 R; 428/68, 293.4; 501/90; 60/257, 267

(56) References Cited

U.S. PATENT DOCUMENTS

| | | | | | |
|---|---|---|---|---|---|
| 3,676,623 | A | | 7/1972 | Gruber | 161/206 |
| 4,425,407 | A | | 1/1984 | Galasso et al. | 428/368 |
| 4,476,178 | A | | 10/1984 | Veltri et al. | 428/215 |
| 4,477,024 | A | | 10/1984 | O'Driscoll et al. | 239/265.11 |
| 4,643,098 | A | * | 2/1987 | Gudbrandsen et al. | 102/513 |
| 4,706,912 | A | | 11/1987 | Perry | 244/158 |
| 4,722,817 | A | | 2/1988 | Nakano et al. | 264/29.5 |
| 4,863,773 | A | * | 9/1989 | Rousseau et al. | 428/68 |
| 4,961,384 | A | | 10/1990 | Sayles | 102/519 |
| 5,291,830 | A | | 3/1994 | Zwan | 102/293 |
| 5,376,599 | A | * | 12/1994 | Oshima et al. | 501/90 |
| 5,380,475 | A | * | 1/1995 | Goedtke et al. | 264/29.5 |
| 5,411,763 | A | | 5/1995 | Weaver et al. | 427/249 |
| 5,462,800 | A | * | 10/1995 | Yamazaki et al. | 428/408 |
| 5,525,372 | A | | 6/1996 | Sayles | 427/255.4 |
| 5,632,601 | A | * | 5/1997 | Bodmer et al. | 416/223 |
| 5,806,791 | A | * | 9/1998 | Hatalsky et al. | 244/3.24 |
| 6,080,455 | A | * | 6/2000 | Purinton et al. | 428/35.5 |
| 6,151,887 | A | * | 11/2000 | Haidn et al. | 60/257 |
| 6,182,442 | B1 | * | 2/2001 | Schmidt et al. | 60/267 |
| 6,254,975 | B1 | * | 7/2001 | Kayser et al. | 428/293.4 |

FOREIGN PATENT DOCUMENTS

| | | |
|---|---|---|
| EP | 0 479 657 A1 | 4/1992 |
| EP | 0 541 917 A2 | 5/1993 |
| JP | 61-122162 | 10/1986 |
| JP | 04286636 | 10/1992 |
| JP | 06305863 | 11/1994 |

* cited by examiner

*Primary Examiner*—Galen L. Barefoot
(74) *Attorney, Agent, or Firm*—St. Onge Steward Johnston & Reens LLC

(57) ABSTRACT

The missile comprises a nose, fixed fins or movable fins, gas rudders, propelling nozzles and blast pipe inserts, combustion chamber liners, tail cone, grid fins, fluid elements and radome or subcomponents of these made of carbon fiber-reinforced silicon carbide (C/SiC) and/or carbon fiber-reinforced carbon (C/C) and/or silicon carbide fiber-reinforced silicon carbide (SiC/SiC) which are integrated in a missile structure. The missile components may be made of C/SiC and/or C/C and/or SiC/SiC with continuous fiber reinforcement and/or chopped fiber reinforcement or combinations thereof. The missile components may be prepared by mechanical machining of C/SiC and/or C/C and/or SiC/SiC blanks either in a single piece or by co-infiltration with carbon or silicon or silicon carbide and/or co-siliconizing of separate C/SiC and/or C/C and/or SiC/SiC segments to result in a monolithic structure. Cooling of the missile components may be achieved by providing cooling ducts and/or recesses in the C/SiC and/or C/C structure and/or the SiC/SiC structure and/or by means of insulating materials such as carbon fiber felts or C/SiC or C/C or SiC/SiC or graphite sheets or combinations thereof.

20 Claims, 7 Drawing Sheets

MISSILE COMPONENTS MADE OF FIBER-REINFORCED CERAMICS

Figure 1:
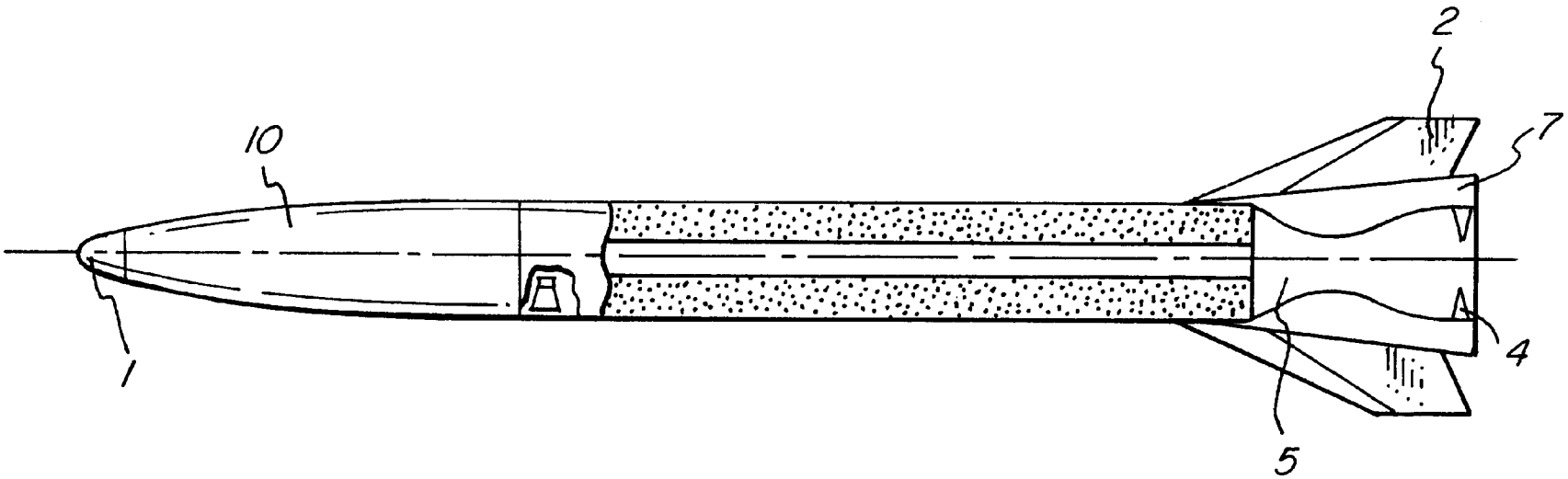
FIG. 1 (PRIOR ART)

This invention is directed to missiles comprising a nose, fixed fins or movable fins, gas rudders, propelling nozzles and blast pipe inserts 5, combustion chamber liners 6, tail cone, grid fins, fluid elements and radomes or subcomponents thereof, said components being made of ceramic material.

Exposed locations such as edges, corners and tips of missiles that move at very high speeds in the near-earth atmosphere, are subject to surface temperatures of more than 1700° C. due to aerodynamic heating. Very high temperatures in excess of 2500° C. occur at components of missile engines the solid propellants of which sometimes burn at temperatures in excess of 3500° C. It is desirable for the components involved to possess sufficient structural strength and functionality even at such temperatures in order to successfully complete the overall task of the missile. Until recently, the structural strength of most of the metallic components that are subject to high-temperature use was realized by employing high-temperature resistant metals and metal alloys, cooling and thermal insulation. Such measures are expensive and in all cases require additional weight so that the given task can be accomplished. In the case of mobile gear, especially missiles, any additional weight is disadvantageous so that weight-reducing solutions should be sought after.

In a known embodiment of a missile, the nose, fixed fins or movable fins, gas rudders, propelling nozzles and blast pipe inserts, combustion chamber liners, tail cone, grid fins, fluid elements and the radome are made of different metals and metal alloys. These missile components are the ones that are exposed to thermal and mechanical maximum loads.

Having regard to the current design of such missile components it is necessary due to the above-mentioned high temperatures, high mechanical loads and high pressures to use high temperature-resistant metals or metal alloys (for instance tungsten, molybdenum, Inconel) that exhibit high mechanical strength and temperature resistance. As these temperature-resistant metals and alloys will soften already at about 800° C. with concurrent losses in strength, additional active cooling is required. Another severe drawback of the metallic components of the missile is their great weight which leads to restrictions in respect of missile acceleration and speed.

It is the object of the present invention to provide noses, fixed fins or movable fins, gas rudders, propelling nozzles and blast pipe inserts, combustion chamber liners, tail cones, grid fins, fluid elements and radomes or subcomponents thereof all made of ceramic material for use with missiles and having high resistance to temperature, pressure and abrasion, erosion resistance, low density or light weight, respectively, high thermal conductivity, low heat expansion, while permitting an almost unlimited variety of geometries and shapes.

As a solution to the specified object the nose, fixed or movable fins, gas rudder, propelling nozzles or blast pipe inserts, combustion chamber liners, tail cone, grid fins, fluid elements and the radome or subcomponents thereof of the kind specified above are characterized in accordance with this invention in that the nose 1, the fixed fins 2 or movable fins 3, the gas rudder 4, the propelling nozzles and blast pipe inserts 5, the combustion chamber liners 6, the tail cone 71 the grid fins 8, the fluid elements 9 and the radome 10, or subcomponents thereof, are made of carbon fiber-reinforced silicon carbide (C/SiC) and/or carbon fiber-reinforced carbon (C/C) and/or silicon carbide fiber-reinforced silicon carbide (SiC/SiC).

Hence the nose 1, the fixed fins 2 or movable fins 3, the gas rudder 4, the propelling nozzles or blast pipe inserts 5, the combustion chamber liners 6, the tail cone 7, the grid fins 8, the fluid elements 9 and the radome 10, or subcomponents thereof are made of fiber-reinforced ceramic material or of combinations of various fiber-reinforced ceramic materials and after infiltration will form a monolithic structure. As an overall effect, the temperature stability of these missile components is increased with a concurrent reduction in weight.

It has been found that C/SiC and/or C/C and/or SiC/SiC possess excellent strength up to high temperatures so as to permit employment even under severe conditions. In addition, besides low density there result high wear resistance, resistance to oxidation and, besides the excellent temperature stability, also high temperature cycle resistance.

The material is particularly gas and liquid-tight when the surface is provided with a protective coating.

The great variety of geometries and shapes in conjunction with low weight as well as the excellent temperature stability and the high or controlled thermal conductivity, which permit correspondingly reduced cooling capacities, should be particularly stressed. With certain missiles it is possible due to the high temperature stability of C/SiC and C/C and SiC/SiC to provide no cooling or thermal insulation at all.

There is a distinction between C/SiC and C/C and SiC/SiC with continuous fiber-reinforcement and chopped fiber-reinforced C/SiC and C/C and SiC/SiC. The former material of C/SiC or C/C or SiC/SiC, which may be laminated, compressed or wound is characterized by particularly high strength and especially low density. A surface coating may be provided in order to increase the resistance to oxidation. To this end it is preferred to apply protective coats of silicon carbide and/or silicon dioxide and/or molybdenum disilicide on the component surfaces. The latter is superfluous in the case of chopped fiber-reinforced C/SiC because this material is particularly resistant to oxidation and corrosion. Also, it exhibits extremely good thermal conductivity and features particularly high resistance to thermal shocks. It is mainly suited for mechanical treatment in its green state. In this connection, noses 1, fixed fins 2 or movable fins 3, gas rudders 4, propelling nozzles or blast pipe inserts 5, combustion chamber liners 6, cone tail 7, grid fins 8, fluid elements 9 and radomes 10 or subcomponents thereof can readily be shaped with random geometries either in a single piece or from various separate segments of C/SiC preforms and/or C/C preforms by mechanical treatment.

Advantageously, the individual segments of nose 1, fixed fins 2 or movable fins 3, gas rudders 4, propelling nozzles and blast pipe inserts 5, combustion chamber liners 6, tail cone 7, grid fins 8, fluid elements 9 and radomes 10 or subcomponents thereof are co-infiltrated or co-siliconized so as to provide the desired monolithic structure. This design is especially suited for C/SiC or C/C or SiC/SiC with chopped fiber-reinforcement, in which case the individual segments are mechanically treated prior to being co-siliconized or infiltrated, respectively. Such a missile component 1–10 can readily be joined by means of fasteners such as screws or bolts or flanges, preferably made of C/SiC and/or C/C and/or SiC/SiC. Also, cooling ducts and/or recesses having round, rectangular or slot-like cross-sections may be incorporated in the missile components 1–10 by mechanical treatment in the green state.

The method according to this invention moreover provides for hybrid-type or segment-type design of the missile components 1–10. Hybrid-type monolithic missile components are formed by mechanical treatment of blanks and sub-segments, which are preferably made of C/SiC and/or C/C and/or SiC/SiC or of appropriate combinations with continuous fiber-reinforcement and/or chopped fiber-reinforcement, and by the subsequent infiltration of these individual segments with silicon and/or silicon carbide and/or carbon.

As a further development of the invention, the inner walls of the missiles or of those missile portions that are subject to high thermal loads are lined in a suitable way with C/SiC or C/C or SiC/SiC segments and provided with cooling via cooling ducts and/or with an insulating material, preferably of C/SiC or C/C or SiC/SiC or of carbon fiber felt or graphite sheet or combinations of these, so that the temperature and pressure loads acting on the metallic missile structure will be reduced as far as possible, and said segments are co-siliconized to form a monolithic missile component 1–10. The insulating materials may also be joined to the missile components 1–10 of C/SiC and/or C/C by interposing spacers therebetween which are preferably made of C/SiC or C/C or SiC/SiC, in order to provide the desired monolithic structure.

Advantageously, the density and porosity of the C/SiC material and/or the C/C material and/or the SiC/SiC material can be controlled during infiltration or siliconizing by the amount of silicon, carbon or silicon carbide added so that C/SiC and/or C/C and/or SiC/SiC with high density and low porosity may be employed as thermomechanical support structure and/or liner material, while C/SiC and/or C/C and/or SiC/SiC with low density and high porosity may be employed as thermal insulation. In this connection it is also possible to adjust density and porosity gradients across the wall thickness of the missile components 1–10.

On account of the gas and liquid tightness of the C/SiC and/or C/C materials it is also possible to incorporate open cooling ducts in the metallic missile structure, said ducts being closed upon assembly of the C/SiC and/or C/C parts and/or SiC/SiC parts. Depending on the system used, the missile component 1–10 is manufactured of separate C/SiC and/or C/C and/or SiC/SiC segments which are subsequently co-infiltrated and/or co-siliconized with carbon and/or silicon and/or silicon carbide to form a monolithic structure, or the missile components 1–10 are made in a single piece, preferably by machining a C/SiC and/or C/C and/or SiC/SiC blank. These C/SiC and/or C/C parts and/or SiC/SiC parts may also provide the cooling ducts (if required) or the recesses for heat dissipation. The body 1–10 of C/SiC and/or C/C and/or SiC/SiC and the metallic missile structure may be joined to one another by means of appropriate connecting elements such as, for instance, bolt, screw or flange joints, preferably made of C/SiC and/or C/C and/or SiC/SiC. Possible ways in this respect are illustrated in FIGS. 2 to 9.

Below, the invention will be described in detail with reference to preferred embodiments thereof in conjunction with the accompanying drawings. The use of missile components 1–10 of fiber-reinforced ceramics (C/SiC and/or C/C and/or SiC/SiC) provides for a considerable reduction in weight as compared with metallic missile components. Cooling may be eliminated either wholly or partly due to the high-temperature stability of C/SiC and/or C/C and/or SiC/SiC. The method according to this invention permits any desired variations in geometry and size of the missile components 1–10.

FIG. 1 illustrates a missile in accordance with the prior art. Because of the high temperature and pressure loads only high-temperature metals and metal alloys having high density can currently be employed which require cooling because of their relatively low temperature stability. Apart from these thermomechanical requirements the metallic materials also need to satisfy all demands regarding corrosion, machining, surface quality and weldability.

Figure 2:
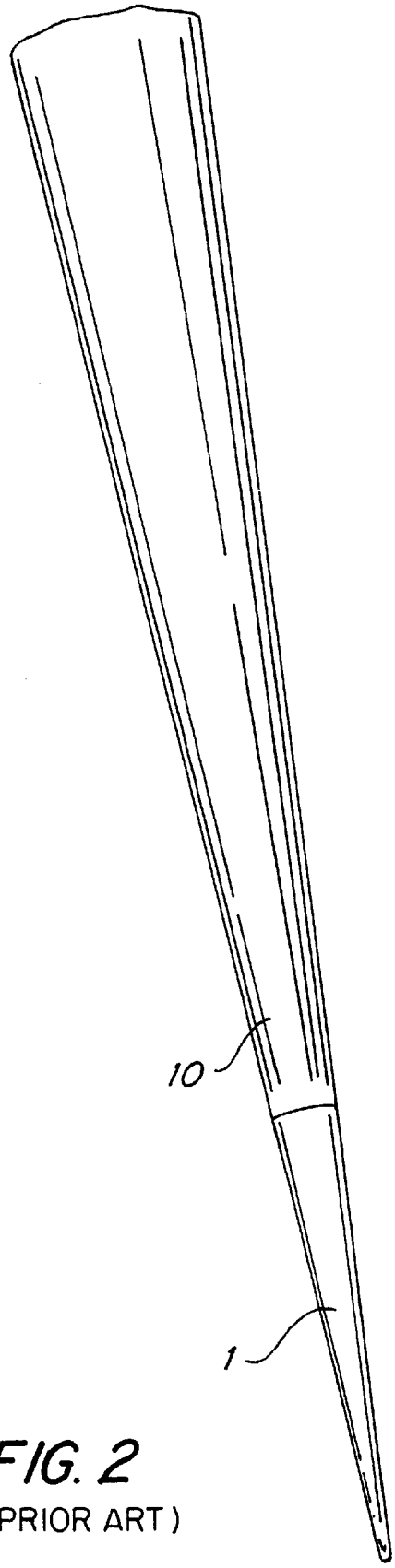
FIG. 2 (PRIOR ART)

FIG. 2 illustrates a nose 1 and a radome 10 of a missile. The nose is particularly subjected to high pressures and high temperatures. Due to the employment of fiber-reinforced ceramics it is possible to reduce the nose weight by at least 1 kg as compared with a metallic nose.

Stress caused by high pressures and high temperatures will occur on radomes. Additionally, radomes require increased radar transmission and surface precision (for instance by grindability) as well as the building-up of different wall thicknesses.

Figure 3:
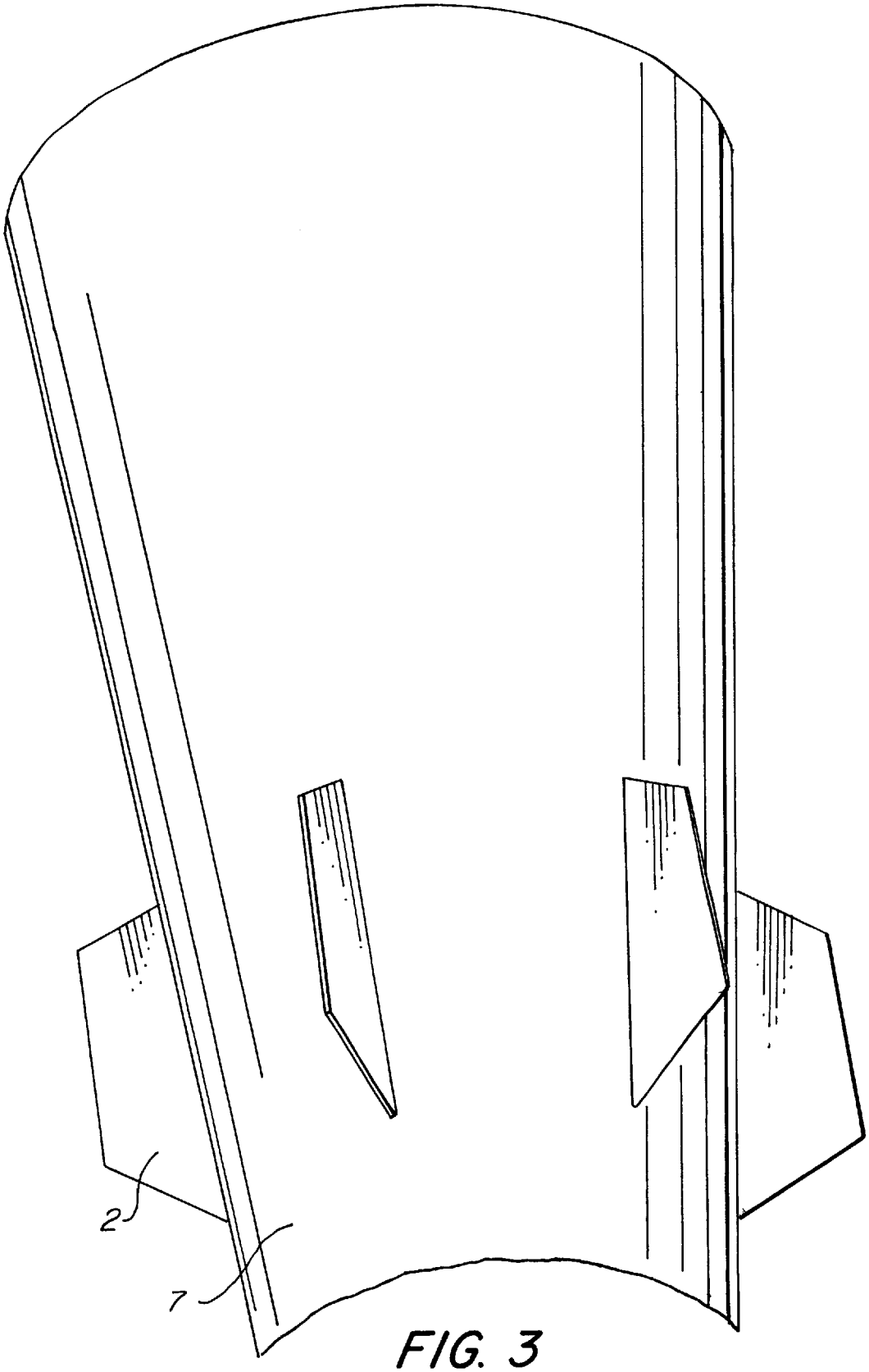

FIG. 3 illustrates the stabilizing fins or fixed fins 2 and the tail cone 7 of a missile. The fixed fins are mainly subjected to stress due to high longitudinal and lateral acceleration forces and high temperatures. The tail cone 7 of a missile is subject to high pressures and high temperatures and is used to stabilize the missile. In the tail cone, the use of fiber-reinforced ceramic leads to a weight reduction of 3 kg.

Figure 4:
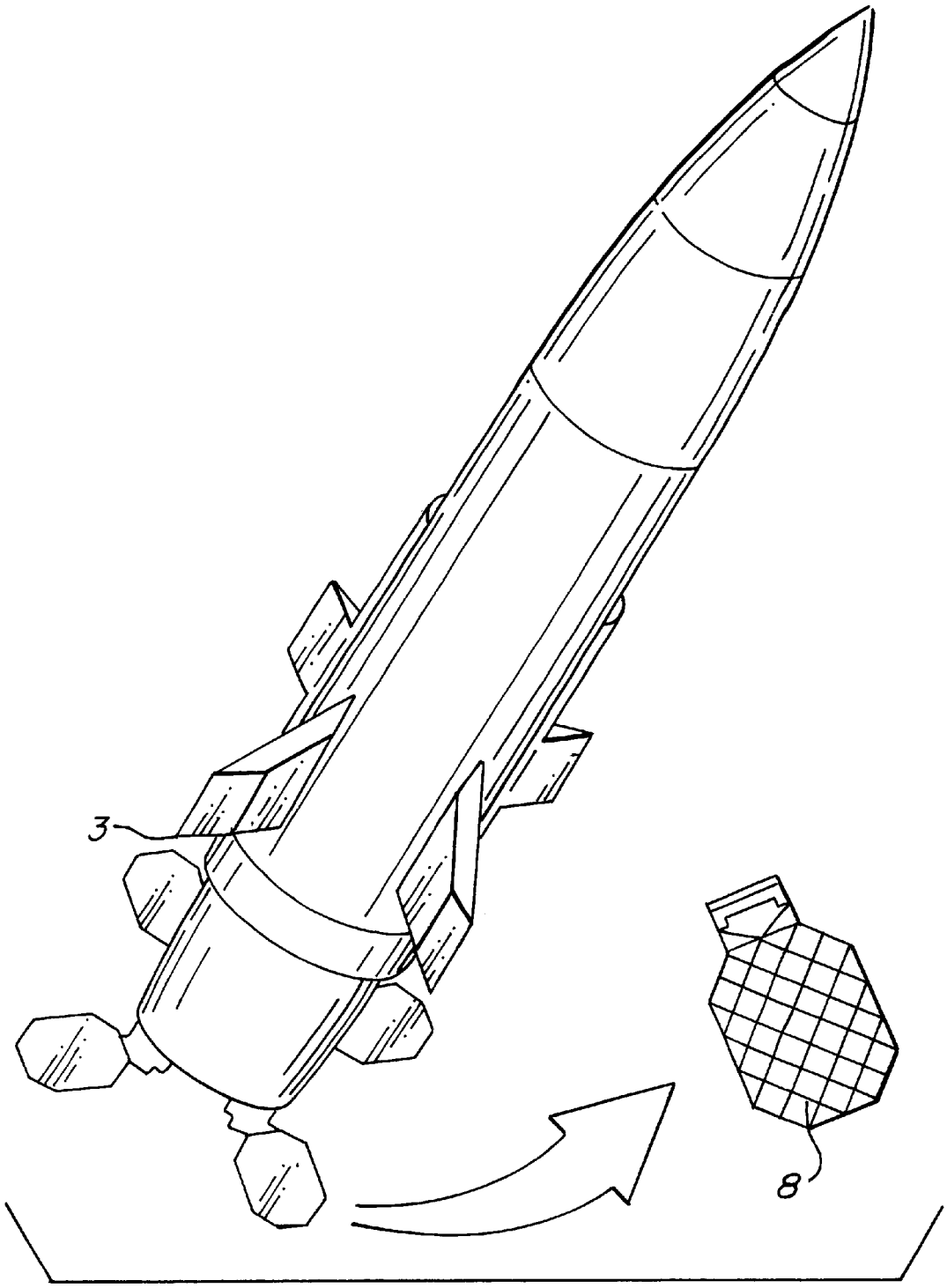

FIG. 4 illustrates movable rudders or fins 3 and grid fins 8. The movable rudders or fins are subject to stress due to high longitudinal and lateral acceleration forces and high temperatures. They are used a aerodynamic steering aids. The grid fins 8 are also subject to high longitudinal and lateral acceleration forces and high temperatures. They are used as both aerodynamic steering aid and for maintaining missile stability. The grid fin looks like a narrow doormat mounted on the tail of the missile, the grid openings facing in the direction of flight and the grid being capable of being turned about the longitudinal axis.

Figure 5:
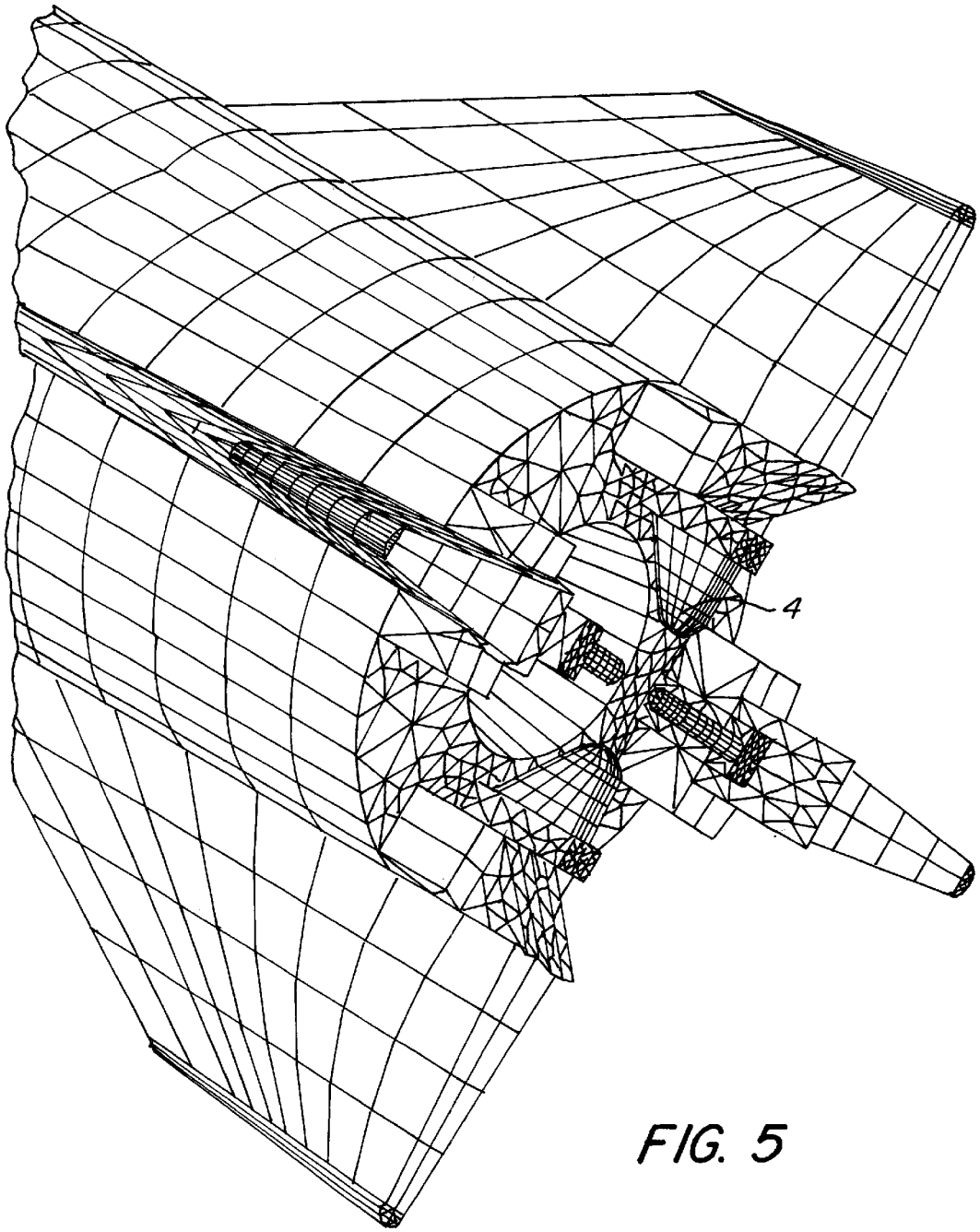

FIG. 5 illustrates the gas rudders 4 in accordance with the invention. Stress due to high lateral forces, temperatures and abrasion caused by exhaust gases and solid particles (for instance $Al_2O_3$ particles) have to be taken into consideration when designing gas rudders. The use of gas rudders in the exhaust jet is an additional steering aid during the driving phase of the missile. Gas rudders which are mounted direct in the exhaust jet in the rear portion of a rocket nozzle in order to deflect the jet are subject to extremely high thermomechanical loads due to the hot, reactive combustion gases and the high lateral forces. Stability against thermal shock and good abrasion performance in respect of solid particles such as, for instance, $Al_2O_3$ and soot, are additionally required for gas rudders because, depending on the type of engine and the kind of propellant, gas rudders may abruptly be subjected to gas/particle flows at temperatures of 2500° C.

Figure 6:
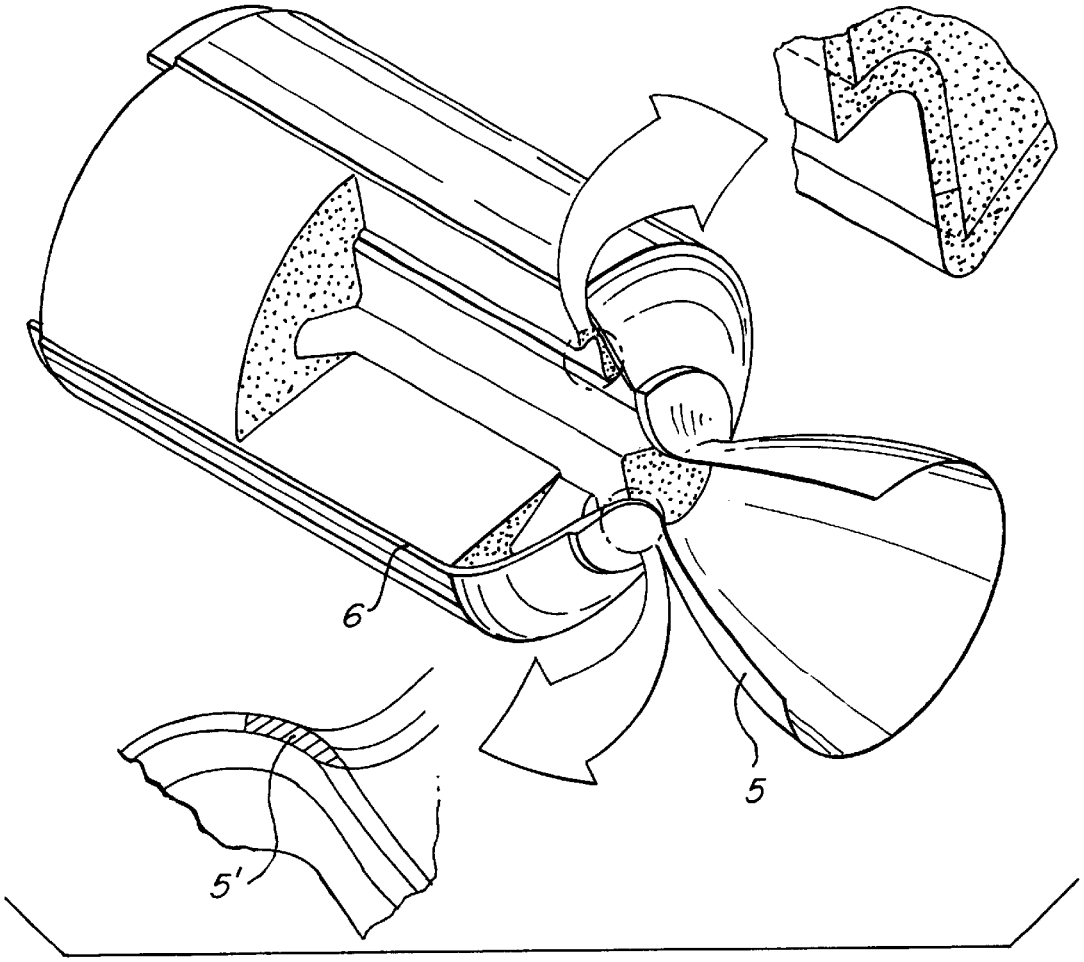

FIG. 6 illustrates a propelling nozzle 5 and the typical embodiment of the combustion chamber liner 6 in accordance with the invention.

The propelling nozzle is subject to stress due to extremely high pressures and temperatures. The power units of missiles frequently have a plurality of propelling nozzles and different numbers of propelling nozzles for the separate propelling stages (ejection stage, acceleration stage and cruising stage).

Figure 7:
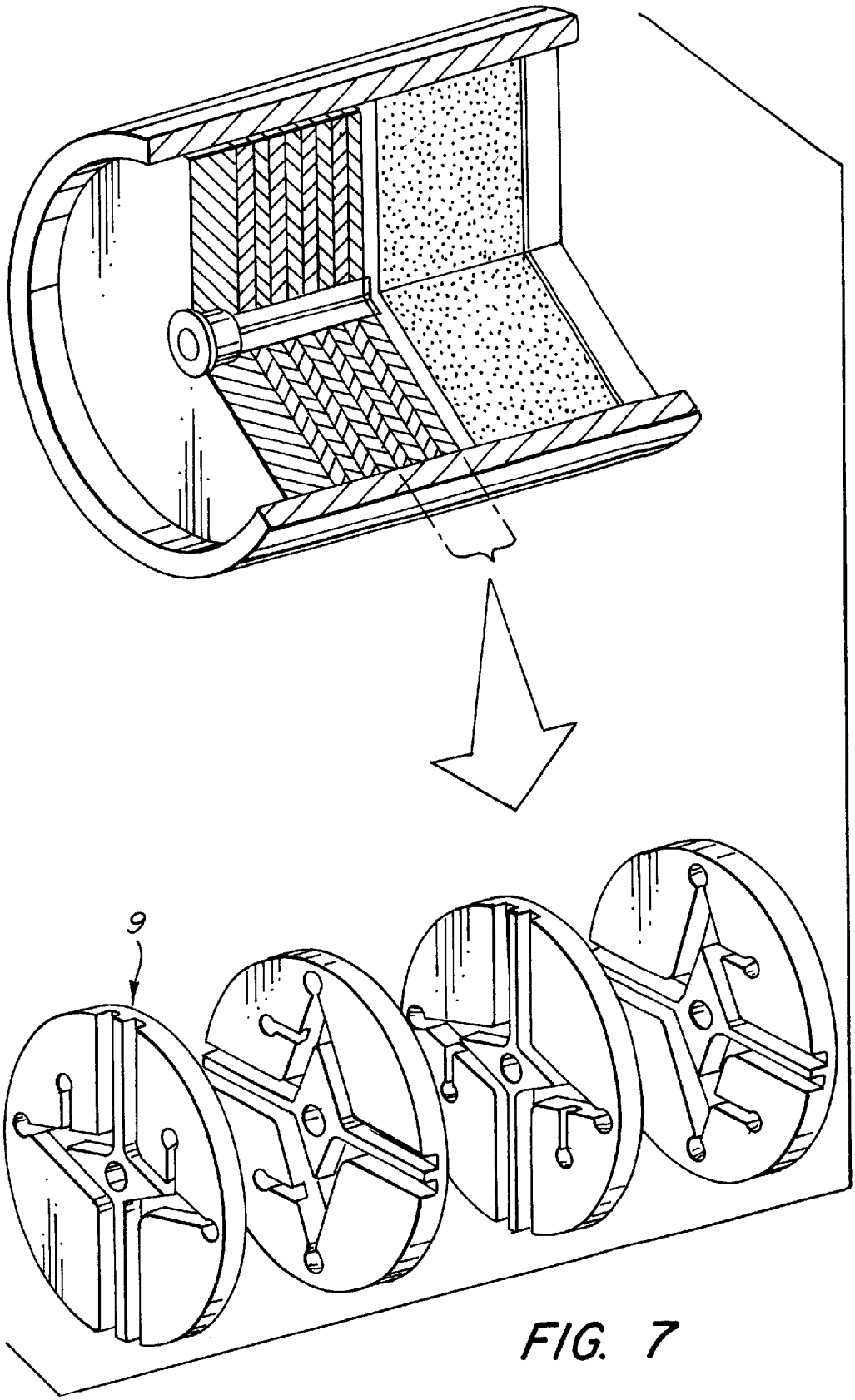

FIG. 7 illustrates typical fluid elements 9 which are employed as lateral thrust controls.

The method according to this invention provides for lining the propelling nozzle and/or the blast pipe and/or the combustion chamber with C/SiC segments and/or C/C segments and/or SiC/SiC segments. The inner walls of the missiles are made of separate segments of C/SiC and/or C/C and/or SiC/SiC. The segments of C/SiC and/or C/C and/or SiC/SiC should be designed in such a way that the dividing slits will not permit the high-pressure and high-temperature gases to penetrate to the metallic missile structure. The C/SiC and/or C/C parts and/or SiC/SiC parts may be adapted to the internal contour of the missile engine and hence permit a geometrical simplification of the missile structure.

A modification of the method provides that the separate C/sic and/or C/C and/or SiC/SiC segments for the missile components (1–10) are mechanically machined from C/SiC and/or C/C and/or SiC blanks, and prior to being assembled into the missile structure they are co-siliconized to form a monolithic structure.

In the examples, cooling may be effected selectively by the incorporation of cooling ducts or recesses in the C/SiC and/or C/C and/or SiC/SiC structure or the provision of insulation with carbon fiber felts or graphite sheets or C/SiC or C/C or SiC/SiC or combinations of these. Depending on the requirements, cooling with cooling ducts may be provided selectively in the missile structure either at the transition from metal to C/SiC and/or C/C and/or SiC/SiC or in the C/SiC part and/or the C/C part and/or the SiC/SiC part itself. A combination of both parts is also provided.

What is claimed is:

1. A missile comprised of components selected from the group consisting of a nose, fins, gas rudders, propelling nozzles and blast pipe inserts, combustion chamber liners, tail cone, fluid elements and a radome, and combinations thereof being made of ceramic material selected from the group consisting of carbon fiber-reinforced carbon (C/C), silicon carbide fiber-reinforced silicon carbide (SiC/SiC), and combinations thereof, whereby at least one of the missile parts possesses high density and low porosity to function as a structure selected from a thermo-mechanical mechanical support and a liner material, at least one another of the missile parts having low density and high porosity to function as a thermal insulation, with the density and porosity of the C/SiC material and/or the C/C material and/or the SiC/SiC material being controlled during infiltration or siliconizing by the amount of silicon, carbon or silicon carbide added.

2. The missile as claimed in claim 1, characterized in that at least one of the missile's components comprise a chopped fiber reinforcement.

3. The missile as claimed in claim 1, characterized in that at least one of the missile components is formed from a plurality of components which are then co-siliconized.

4. The missile as claimed in claim 1, characterized in that at least one of the missile components is manufactured by machining a [C/SiC] blank.

5. The missile as claimed in claim 1, characterized in that at least one of the missile components is provided with recesses so as to reduce its weight.

6. The missile as claimed in claim 5, characterized in that at least one of the recesses is formed by machining blanks.

7. The missile as claimed in claim 1, characterized in that at least of one the missile components is provided with thermal insulation.

8. The missile as claimed in claim 1, characterized in that at least one of the missile components possess high density and low porosity to function as a structure selected from a thermal-mechanical support and a liner material, at least one another o the missile parts having low density and high porosity to function as a thermal insulation.

9. The missile as claimed in claim 1, further comprising means selected from the group including silicon, silicon carbide, carbon, and combinations of these for connecting at least two components to form a monolithic missile component.

10. The missile as claimed in claim 1, characterized in that the missile components comprise any desired geometry.

11. The missile as claimed in claim 1, characterized in that at least one of the missile components is surface-coated with protective coats, selected from a group including silicon carbide, silicon dioxide, molybdenum silicide, and combinations of these.

12. The missile as claimed in claim 1, characterized in that at least of one the missile components is provided with cooling ducts.

13. The missile as claimed in claim 1, characterized in that at least two of the missile components.

14. A process for manufacturing missile parts selected from the group consisting of a nose, fins, gas rudders, propelling nozzles and blast pipe inserts, combustion chamber liners, tail cone, fluid elements and a radome, and combinations of these, comprising the steps of:

providing uncoated carbon fibers; and shaping uncoated carbon fibers with a material selected from the group consisting of reinforced silicon carbide and reinforced carbon, and combinations of these, thereby manufacturing the selected missile part.

15. A missile comprising:

at least one part selected from the group consisting of a nose, fins, gas rudders, propelling nozzles and blast pipe inserts, combustion chamber liners, tail cone, fluid elements and a radome, and combinations thereof and a high density and low porosity ceramic material selected from the group consisting of carbon fiber-reinforced carbon, silicon carbide fiber-reinforced silicon carbide, and combinations thereof;

at least one another part selected from the group consisting of a nose, fins, gas rudders, propelling nozzles and blast pipe inserts, combustion chamber liners, tail cone, fluid elements and a radome, said one another part having an inner and outer sides; and a low density and high porosity ceramic material selected from the group consisting of carbon fiber-reinforced silicon carbide, carbon fiber-reinforced carbon, silicon carbide fiber-reinforced silicon carbide, and combinations thereof, said ceramic material being lined with the inner side of the one another part.

16. The missile defined in claim 15, further comprising an insulating layer made of material selected from the group consisting of carbon fiber-reinforced silicone carbide, carbon fiber-reinforced carbon, silicon carbide fiber-reinforced silicon carbide, carbon fiber felt, graphite sheet and combinations of these, said insulating layer being applied to a side o the segment facing away from the inner side of the one another part.

17. The missile defined in claim 15 further comprising at least one cooling duct provided in a component selected from the group consisting of the segment, one another part and a combination thereof.

18. The missile defined in claim 15 wherein the segment is made form the material having high density and low porosity to be employed as a thermomechanical support.

19. The missile defined in claim 15 wherein the segment is made of the material having low density and high porosity to be employed as a thermal insulation.

20. The missile defined in claim 15 wherein the parts are joined to one another by elements selected from the group consisting of a bolt, screw, flange joints and combinations of these made of a material selected from the group consisting of carbon fiber-reinforced silicon carbide, carbon fiber-reinforced carbon, silicon carbide fiber-reinforced silicon carbide.

* * * * *